United States Patent [19]

Hyuga et al.

[11] Patent Number: 4,627,577

[45] Date of Patent: Dec. 9, 1986

[54] FLOW CONTROL SYSTEM IN SHREDDING MACHINE

[75] Inventors: Kounosuke Hyuga, Naka; Koutaro Nakamura, Kamakura; Shouzou Ogawa, Ibaraki, all of Japan

[73] Assignee: Japan Tobacco Inc., Tokyo, Japan

[21] Appl. No.: 686,488

[22] Filed: Dec. 26, 1984

[30] Foreign Application Priority Data

Dec. 27, 1983 [JP] Japan ..... 58-244866

[51] Int. Cl.[4] ..... B02C 25/00

[52] U.S. Cl. ..... 241/30; 241/34; 241/36; 241/223

[58] Field of Search ..... 241/34, 35, 36, 223, 241/30

[56] References Cited

U.S. PATENT DOCUMENTS 4,212,429 7/1980 Cuvelier et al. ..... 241/36 X
4,223,845 9/1980 Selonke et al. ..... 241/36 X
4,452,400 6/1984 Williams ..... 241/36

FOREIGN PATENT DOCUMENTS 1532062 4/1976 Fed. Rep. of Germany .
118898 10/1976 Japan .
45185 11/1980 Japan .

*Primary Examiner*—Mark Rosenbaum
*Attorney, Agent, or Firm*—Shlesinger, Arkwright, Garvey & Fado

[57] ABSTRACT

A flow control system in a tobacco shredding machine or the like having a conveyor means for conveying raw material under compression up to a shredding port and a rotary drum cutter adapted to rotate in close proximity to the shredding port and shred the raw material forced out from the shredding port. A rotational torque of the rotary drum cutter is detected by a torque detecting means and the number of revolutions of the same cutter is detected by a number-of-revolutions detecting means, then on the basis of the detected rotational torque and number of revolutions the number of revolutions of the rotary drum cutter is controlled so as to give a target flow rate of raw material by a number-of-revolutions control means, and the conveyance speed of the conveyor means is controlled in synchronism with the rotary drum cutter by a speed control means. The flow rate of raw material can be maintained constant and the quality of shredded pieces is stable. There is no problem of the increase of cost nor is there an increase of the installation space.

14 Claims, 2 Drawing Figures

FLOW CONTROL SYSTEM IN SHREDDING MACHINE

BACKGROUND OF THE INVENTION

The present invention relates to a flow control system in a tobacco shredding machine or the like and more particularly to a flow control system for mantaining constant the flow rate of raw material shredded by a tobacco shredder or the like.

Generally, in a tobacco shredding machine, tobacco leaves, as the raw material, are conveyed to a shredding port provided in front of two upper and lower press conveyors, while being compressed by those conveyors, and are shredded by means of a rotary drum cutter which is rotating in close proximity to the shredding port.

The tobacco leaves thus shredded are delivered to the step which follows the shredding step by the shredding machine, namely, the drying step, the perfume adding step or the mixing step. In this case, maintaining constant the flow rate of the shredded tobacco leaves being delivered to the subsequent step is very important for various purposes, for example, not only for stabilization of the quality of shredded tobacco leaves but also for reduction of load variations in the drying step, for uniform addition of perfume and improvement of the mixing accuracy.

To this end, in the shredding machine and its peripheral equipment, various flow control systems have heretofore been proposed, which are classified into the following three systems.

According to the first system, the flow rate of tobacco leaves entering the shredding machine is kept constant, as proposed in Japanese Patent Application Laid Open Publication No. 118898/76 and Patent Application Publication No. 45185/80.

According to the second system, the flow rate of tobacco leaves which have been shredded by the shredding machine is measured by a continuous weighing machine, and the measured signal is fed back to the shredding machine to directly or indirectly control the procesing flow rate in the shredding machine.

According to the third system, as proposed in DT No. 1532062, taking note of the fact that, of upper and lower press conveyors of the shredding machine, the upper press conveyor for pressing raw material at a constant pressure moves vertically according to the amount of raw material. A measuring member for measuring the amount of such vertical movement is attached to the upper side of a shredding port which vertically moves simultaneously with the upper press conveyor. The measurement result obtained by the measuring member is fed to a speed control section of a press conveyor driving device to control the speed of the upper and lower press conveyors to thereby keep constant the amount of raw material extruded to the shredding port.

However, the first and second systems require various equipments and devices in addition to the shredding machine, thus causing problems such as the increase of cost and of installation space.

The third system does not cause such problems as the increase of cost and that of installation space because the shredding machine per se controls the flow rate. However, the density of raw material passing the shredding port varies depending on the strength of compression by the press conveyors, and even at the same strength of compression. A change in the moisture content of the raw material will cause a change in physical properties, such as softness of the raw material and hence a change in density of the raw material under compression. Thus, the control accuracy can be maintained only under limited conditions.

SUMMARY OF THE INVENTION

The present invention has been developed in view of the above-mentioned circumstances, and it is the object thereof to provide a flow control system in a shredding machine free of problems regarding cost and installation space and which is also capable of maintaining the control accuracy under various conditions.

More specifically, taking note of the fact that the work done in cutting material across a constant cutting width is proportional to the quantity of cut material, the present invention detects the rotational torque of a rotary drum cutter during the shredding of the raw material. The number of revolutions of the rotary drum cutter is controlled so that the product (power of the rotary drum cutter) of the detected rotational torque value and the number of revolutions of the rotary drum cutter remains constant, to thereby keep constant the flow rate of raw material being shredded.

Thus, the control system of the present invention is of a relatively simple construction and yet can solve the problems of conventional flow control systems in shredding machines and can contribute to process simplification.

BRIEF DESCRIPTION OF THE DRAWINGS

The drawings illustrate embodiments of the present invention, in which.

DESCRIPTION OF PREFERRED EMBODIMENTS

Figure 1:
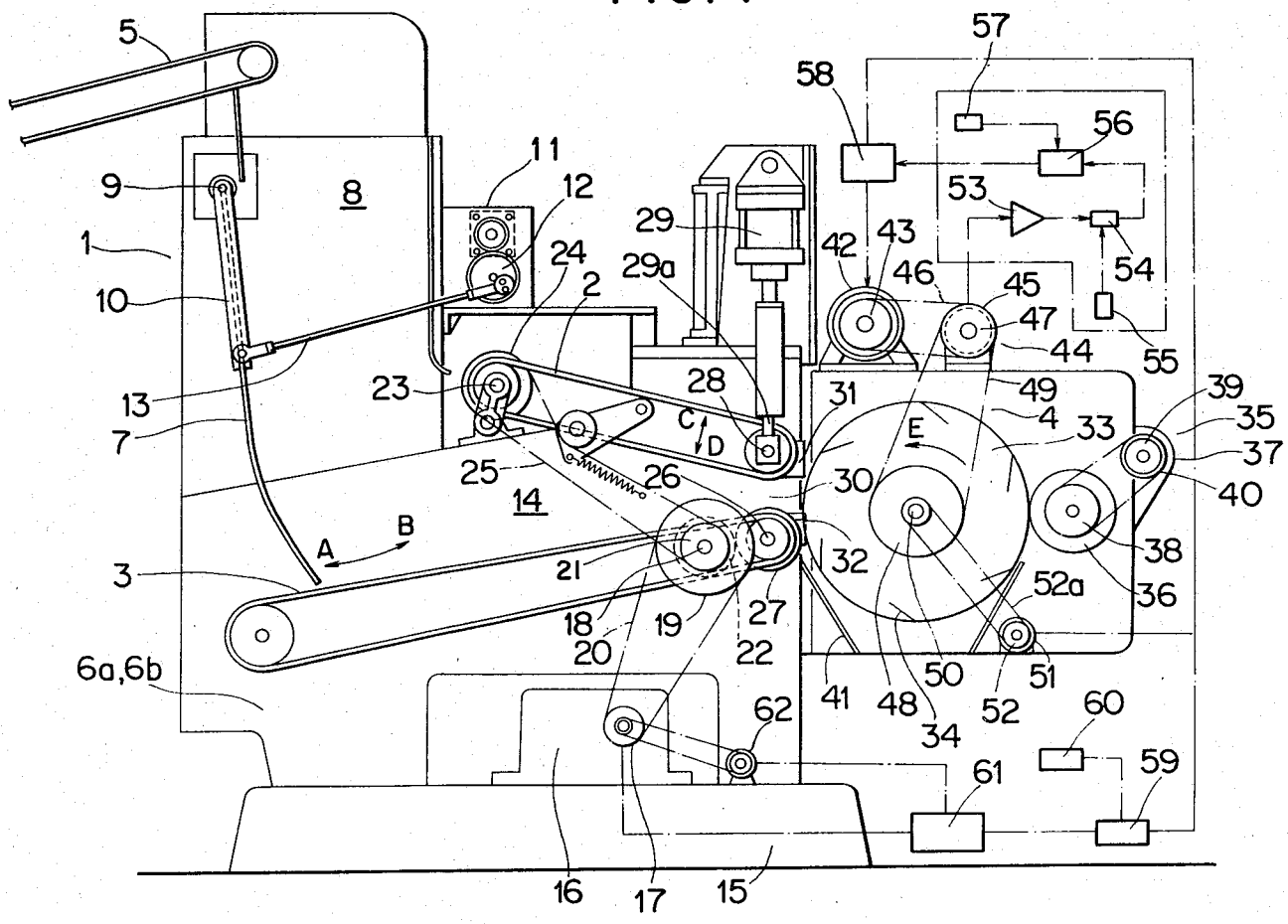
FIG. 1 is a schematic side view showing a first embodiment of the present invention.

Embodiments of the present invention will be described hereinunder with reference to the drawings.

First, the entirety of a tobacco leaf shredding machine will be explained with reference to FIG. 1, which illustrates a first embodiment of the present invention. The shredding machine comprises a hopper 1, upper and lower press conveyors 2 and 3, and a rotary drum cutter 4.

The hopper 1 is for guiding tobacco raw material to between the upper and lower press conveyors 2 and 3, the tobacco raw material being fed into the hopper from a raw material feeding belt conveyor 5. Hopper 1 comprises certain portions of side frames 6*a* and 6*b* and a raw material feed plate 7. The raw material feed plate 7 is attached to a link arm 10 which is mounted within a feed passage 8 through a pin 9, the feed passage 8 being formed by the side frames 6*a* and 6*b*. The link arm 10 is connected to one end of a link arm 13. The other end of the link arm 13 is pivotally connected to a rotating disc 12 which is rotated by a motor 11. By the link arms 10 and 13 and the motor 11, the raw material feed plate 7 is moved pivotally about the pin 9 in the directions of arrows A and B in FIG. 1, whereby the tobacco raw material is pushed in between the upper and lower press conveyors 2 and 3.

The upper and lower press conveyors 2 and 3, which are mounted between the side frames 6*a* and 6*b*, convey the tobacco raw material to the rotary drum cutter 4 while also compressing the raw material. The upper press conveyor 2 is shorter than the lower press conveyor 3, and a feed passage 14 formed between the upper and lower conveyors 2 and 3 becomes gradually narrower toward the rotary drum cutter 4.

The upper and lower press conveyors 2 and 3 are driven by a variable speed motor 16 having a reduction gear and which is mounted on a bedplate 15. More specifically, a chain 20 is stretched between a sprocket 17 fixed to the output shaft of the motor 16 and a main sprocket 19 mounted rotatably on an intermediate shaft 18 which is disposed on one side of the side frames 6*a* and 6*b*. To the main sprocket 19 are fixed an intermediate sprocket 21 and a main gear 22, and a chain 25 is stretched between the intermediate sprocket 21 and a sub sprocket 24 which is fixed to a tail-side wheel shaft 23 of the upper press conveyor 2. The main gear 22 is in mesh with a sub sprocket 27 which is fixed to a head-side wheel shaft 26 of the lower press conveyor 3. Upon operation of the motor 16, the rotation thereof is transmitted from the sprocket 17 through the chain 20 to the main sprocket 19, intermediate sprocket 21 and main gear 22, and then transmitted from the intermediate sprocket 21 to the sub sprocket 24 through the chain 25, and also from the main gear 22 to the sub gear 27. As a result, the sub sprocket 24 and the sub gear 27 rotate in directions opposite to each other, whereby the upper and lower press conveyors 2 and 3 are driven so as to convey the tobacco raw material toward the rotary drum cutter 4.

The upper press conveyor 2 is movable pivotally about the tail-side wheel shaft 23 in the directions of arrows C and D in FIG. 1, and to its head-side wheel shaft 28 are pivotally connected the fore end portions of cylinder rods 29a of press cylinders 29 which are respectively mounted in an upright state to the front upper portions of the side frames 6*a* and 6*b*. That is, the upper press conveyor 2 is mounted in a suspended state at its head side by the press cylinders 29.

To the fore end portions of the cylinder rods 29 of the press cylinders 29 is fixed a press plate 31 which constitutes an upper side portion of shredding port 30 through which the tobacco raw material is forced through to the rotary drum cutter 4.

The shredding port 30 is defined by the press plate 31, a plate receiving plate 32 mounted on the head side of the lower press conveyor 3, and right and left guides (not shown) as extensions of the side frames 6*a* and 6*b*.

The compressing force of the upper press conveyor 2 and press plate 31 is set by a reducing valve having a relief (not shown), which valve regulates the pressure of fluid entering the press cylinders 29.

The tobacco raw material, which has been forced in between the upper and lower conveyors 2 and 3 becomes compressed as it approaches the shredding port 30. The compressed raw material is discharged in the form of a flat lump through the shredding port 30.

The rotary drum cutter 4 cuts the flat lump-like tobacco raw material discharged from the shredding port 30 into a predetermined width. The cutter 4 is composed of plural knives 34 disposed at predetermined intervals on the outer peripheral surface of a drum 33. Cutter 4 is mounted in close proximity to the shredding port 30.

The cutting edge of each knife 34 is ground continually during operation by means of a grinder 35 so that it remains suited for a high-speed processing over long period of time. The grinder 35 is composed of a grinding wheel 36, a motor 37 and a transmission mechanism for transmitting the rotation of the motor 37 to the grinding wheel 36. The transmission mechanism comprises pulleys 38 and 39 and a belt 40. The grinding wheel 36 is rotated and at the same time reciprocated in the axial direction of the drum 33. The drum 33 contains a knife delivery mechanism for feeding each knife 34 by a length corresponding to the ground length continuously or intermittently little by little in synchronism with the rotation of the rotary drum cutter 4, whereby the sharpness of the knife and the gap between the edge of the knife 34 and the shredding port 30 are kept constant.

The tobacco raw material, which has been shredded into a predetermined width, is then fed to the following step through discharge chute 41 which is disposed substantially just under the rotary drum cutter 4.

Features of the present invention will now be further explained. A belt 46 is stretched between a pulley 43 fixed to the output shaft of DC motor 42 which drives the rotary drum cutter 4 and pulley 45 fixed to an input portion of torque transducer 44. Further, a belt 49 is stretched between pulley 47 fixed to an output portion of the torque transducer 44 and a pulley 49 fixed to the main shaft of the rotary drum cutter 4. Through these belts 46 and 49, the rotation of the DC motor 42 is transmitted to the drum cutter 4, whereby the cutter 4 is rotated in the direction of the arrow E in FIG. 1. In this way, the rotational torque is detected by the torque transducer 44.

Torque transducer 44, which is a strain gauge type, detects as an electric signal a torsional force applied between the input portion at one shaft end and the output portion at the other shaft end.

Further, a belt 52*a* is stretched between a pulley 50 fixed to the main shaft of the rotary drum cutter 4 coaxial with the pulley 48 and a pulley 52 fixed to an input shaft of a tachometer generator 51. The number of revolutions of the rotary drum cutter 4 is detected as an electric signal by the tachometer generator 51.

The detection signal (rotational torque) from the torque transducer 44 is amplified by an amplifier 53 and the resulting signal is then fed to a computing unit 54. To the computing unit 54 is connected a setting unit 55 which produces a voltage corresponding to the rotational torque in the no-load operation (rotation without the shredding of raw material), and the computing unit 54 subtracts from the detection signal the voltage corresponding to the rotational torque in the no-load operation, whereby the net rotational torque value required for the shredding of the raw material is calculated. This net rotational torque value is proportional to the net sectional area of raw material which corresponds to the shredded section of the flat lump-like tobacco raw material formed by the shredding port 30 minus the void portion. And it is proportional to a shredding weight per unit time of shredding provided the raw material shredding, width is constant. Therefore, the net rotational torque value is not affected at all even by a change in density (void volume) of raw material.

The above net rotational torque value is input to a computing unit 56. To the computing unit 56 is connected a setting unit 57 which produces a voltage corresponding to a target flow rate of tobacco leaves to be shredded, and the computing unit 56 divides this target value by the net rotational torque value. The target value of the flow rate of tobacco leaves is the product of the rotational torque and the number of revolutions of the rotary drum cutter 4. Dividing the target value by the net rotational value results in the target number of revolutions. A voltage corresponding to this target number of revolutions is then fed from the computing unit 56 to a power amplifier 58.

Also fed to the power amplifier 58 is the number of revolutions of the rotary drum cutter 4 from the tachometer generator 51. The power amplifier 58 compares this number of revolutions with the target number of revolutions and controls the DC motor 42 so as to rotate at the target number of revolutions.

The number of revolutions of the rotary drum cutter 4 is also fed to a computing unit 59 from the tachometer generator 51. To the computing unit 59 is connected a setting unit 60 which generates a voltage corresponding to the target value of the shredding width. The computing unit 59 obtains a target number of revolutions of the motor 16 from the number of revolutions of the rotary drum cutter 4 and the above target value, and outputs a voltage corresponding to this target number of revolutions to a power amplifier 61.

To the power amplifier 61 is connected a tachometer generator 62 which rotates in synchronism with the motor 16 and which generates a voltage corresponding to the number of revolutions of the motor 16. The power amplifier 61 compares this number of revolutions with the target number of revolutions and controls the motor 16 so as to rotate at the target number of revolutions. As a result, the upper and lower press conveyors 2 and 3 are driven in synchronism with the number of revolutions of the rotary drum cutter 4, whereby the shredding rate of tobacco raw material is maintained constant.

The operation of the above embodiment will be described below.

Tobacco raw material is fed from the raw material feeding belt conveyor 5 into the hopper 1 and forced in between the upper and lower press conveyors 2 and 3 by means of the raw material feed plate 7. The tobacco raw material thus forced in between both conveyors is compressed by the preset compressing force of the press cylinders 29 during the conveyance to the shredding port 30. Then, it is forced out from the shredding port 30 and shredded by the knives 34. At this time, since the rotary drum cutter 4 and the upper and lower press conveyors 2 and 3 are driven in synchronism with each other, the tobacco raw material is shredded at a constant width.

During shredding of the tobacco raw material, the rotational torque value of the rotary drum cutter 4 is detected as an electric signal by the torque transducer 44. This rotational torque value is fed through the amplifier 53 to the computing unit 54, in which a net rotational torque value is obtained. This net rotational torque value is fed to the computing unit 56, which in turn divides the target quantity of tobacco raw material to be shredded by the net rotational torque value to obtain a target number of revolutions, and outputs this target number of revolutions to the power amplifier 58. The power amplifier 58 compares the number of revolutions fed from the tachometer generator 51 with the target number of revolutions and controls the DC motor in accordance with the result of the comparison.

For example, when the rotational torque value increases, the number of revolutions is reduced, while when the rotational torque value becomes smaller, the number of revolutions is increased, thereby controlling constant the flow rate of tobacco raw material being shredded.

Even if the density of tobacco raw material changes during compression, the number of revolutions will never change because the rotational torque value is proportional to the net sectional area of the raw material corresponding to the shredded section of the raw material minus void portion. That is, even in the event of a change in the raw material density during compression, the number of revolutions of the rotary drum cutter 4 is controlled to keep constant the flow rate of the shredded tobacco raw material without being influenced thereby.

As the number of revolutions of the rotary drum cutter 4 changes, the motor 16 is so controlled as to synchronize the rotary drum cutter 4 by means of the power amplifier 61. For example, when the number of revolutions of the cutter becomes smaller, the conveyance speed of the upper and lower press conveyors 2 and 3 decreases in proportion thereto, while when the number of revolutions becomes larger, the conveyance speed increases proportionally, whereby the shredded width of tobacco raw material is controlled constant.

The tobacco raw material thus shredded by the rotary drum cutter 4 is sent to the following step at a constant flow rate.

Figure 2:
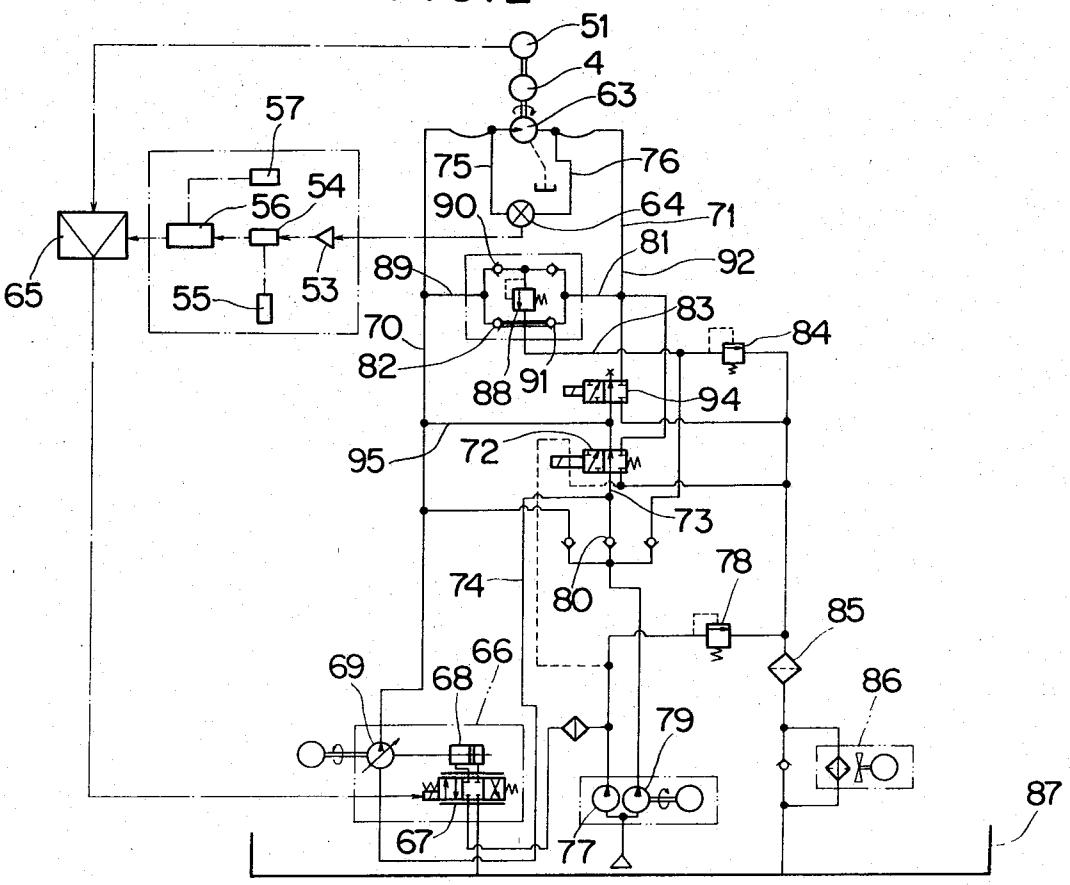
FIG. 2 is a schematic view showing a second embodiment of the present invention.

Referring now to FIG. 2, there is illustrated a second embodiment of the present invention, in which a hydraulic motor 63 is used as the drive source for the rotary drum cutter 4. Since the differential pressure between the primary- and secondary-side pressures of the hydraulic motor 63, namely, drive pressure, has a very high correlation with the output torque of the hydraulic motor 63, this drive pressure can be assumed equal to the foregoing rotational torque value.

Pressure conduits 75 and 76 are provided in a branched fashion, respectively on an inlet side (primary side) and an outlet side (secondary side) of the hydraulic motor 63, and they are connected to a differential pressure transducer 64. The differential pressure transducer 64 detects the drive pressure, converts it into an electric signal and outputs the electric signal to the computing unit 54 through the amplifier 53. The computing unit 54 subtracts from this drive pressure the no-load drive pressure to obtain a net drive pressure and outputs the latter to the computing unit 56, which in turn divides the target quantity of the tobacco raw material to be shredded by the net drive pressure to obtain a target number of revolutions and outputs the latter to a signal amplifier 65.

To the signal amplifier 65 is also fed the number of revolutions of the rotary drum cutter 4 from the tachometer generator 51. The signal amplifier 64 compares this number of revolutions with the target number of revolutions and outputs a control signal to an electro-hydraulic servo meachanism 66.

The electro-hydraulic servo mechanism 66, which comprises a servo valve 67 and a servo cylinder 68, controls the amount of hydraulic fluid to be discharged by a pump 69.

The hydralic fluid discharged from the pump 69 is fed to the inlet (primary side) of the hydraulic motor 63, through a line 70, and after release of its pressure energy in the hydraulic motor 63, it returns from the outlet (secondary side) to the pump 69 through line 71, flow path switching valve 72 and lines 73 and 74. The hydraulic motor 63 thereby controls the number of revolutions of the rotary drum cutter 4 to the foregoing taget number of revolutions.

Though not shown, the speed of the upper and lower press conveyors 2 and 3 is controlled in synchronism with the number of revolutions of the rotary drum cutter 4, and this is the same as in the foregoing first embodiment.

A pump 77 supplies a hydraulic fluid for driving the servo cylinder 68. The pressure of this hydraulic fluid is adjusted by a pressure regulating valve 78.

Further, hydraulic fluid discharged from pump 79 passes through a check valve 80 and flows into the line 74. It is thereby stained in the lines 70, 71, 73 and 74, and a part of the hydraulic fluid which has become hot passes through line 81, check valve 91, line 83, pressure regulating valve 84, filter 85 and cooler 86 and returns to a tank 87.

A pressure regulating valve 88 acts as a safety valve when the load on the rotary drum cutter 4 is increased and a pressure higher than the rated value is applied to the hydraulic motor 63 and pump 69, thereby preventing damage of the motor 63 and pump 69. In this case, the hydraulic fluid passes through lines 70, 89, check valve 90, pressure regulating valve 88 and check valve 91, and a part thereof passes through lines 81 and 92 and returns to the inlet of the pump 69. Also, a part thereof passes through line 83 and pressure regulating valve 84, which operates at a pressure lower than the operating pressure of the pressure regulating valve 88, and returns to the tank 87.

When the flow path switching valve 72 is in the position shown in FIG. 2, to cut off the communication of lines 71 and 73 and the hydraulic motor 63 is not in operation, if the flow path switching valve 94 is switched to line 94 to short-circuit the lines 71, 95 and 70, the hydraulic motor 63 can be rotated manually.

In this second embodiment, if the hydraulic pressure on the outlet side of the hydraulic motor 63 is kept substantially constant by the pressure regulating valve 84, etc., the primary side pressure can be made the foregoing drive pressure. In this case, the setting unit 55 is adjusted so as to generate a voltage signal corresponding to the primary side pressure in a no-load condition.

The present invention is not limited to the application to tobacco shredders. For example, it is also applicable to a pulp shredder or the like to keep constant the flow rate of raw material to be shredded.

According to the present invention, as set forth hereinabove, a rotational torque value of the rotary drum cutter during shredding is detected by torque detecting means (torque transducer 44, differential pressure transducer 64) and a number of revolutions is detected by number-of-revolutions detecting means (tachometer generator 51), then on the basis of the detected rotational torque value and number of revolutions, the number of revolutions of the rotary drum cutter is so controlled as to give a target flow rate of raw material by the number-of-revolutions control means (amplifier 53, computing units 54 and 56, setting units 55 and 57, power amplifier 58, signal amplifier 65). The conveyance speed of the conveyor means (upper and lower press conveyors 2 and 3, motor 16) is controlled in synchronism with the rotary drum cutter by a speed control means (computing unit 59, setting unit 60, power amplifier 61, tachometer generator 62). Consequently, the flow rate of raw material can be controlled constant independently of the compressing force for the raw material in the shredding port, the moisture content of raw material, etc., thereby assuring a stable quality of shredded pieces. Besides, there is no problem of the increase of cost nor is there an increase in the installation space because it is not necessary to provide special equipment for flow control before and after the shredding machine.

What is claimed is:

1. A flow control system in combination with a shredder having raw material conveyor means upstream of a rotary shredder means, comprising:

(a) torque measuring means for connection to a shredder means for monitoring the operating torque of the shredder means;

(b) tachometer means for connection to the shredder means for monitoring the number of revolutions per unit time of the shredder means;

(c) means for generating a target constant;

(d) means for comparing the product of the measured torque and the number of revolutions with said target constant; and, (e) speed control means for connection to the shredder means for regulating the rotary speed of the shredder means in response to deviations of the product with said target constant so that a constant shredding rate is maintained.

2. The system of claim 1, further comprising:

(a) speed regulating means for connection to a raw material conveyor means for regulating the speed thereof;

(b) speed monitoring means for connection to the conveyor means; and, (c) comparator means connected to said speed monitoring means, said tachometer means and said speed regulating means for synchronizing the speed of the conveyor means with the rotary speed of the shredder assembly.

3. The system of claim 2, wherein:

(a) said comparator means being adapted for increasing the speed of the conveyor means as the number of revolutions increases and for decreasing the speed of the conveyor means as the number of revolutions decrease.

4. The system of claim 1, wherein:

(a) said target constant being proportional to the flow rate of raw material divided by the torque exerted in shredding the raw material.

5. The system of claim 1, wherein:

(a) said torque monitoring means including a torque transducer.

6. The system of claim 5, wherein:

(a) said torque transducer including a strain gauge.

7. The system of claim 1, wherein:

(a) said torque measuring means including a differential pressure transducer.

8. A tobacco shredder, comprising:

(a) a hopper having an inlet and an outlet for holding a supply of tobacco;

(b) first and second adjacently disposed cooperating conveyor means juxtaposed to said outlet for transporting tobacco therefrom;

(c) rotary cutter means adjacent the discharge end of said conveyor means for shredding tobacco;

(d) drive means for operating said conveyor means so that tobacco is transported from said hopper to said cutter means;

(e) rotary drive means for said rotary cutter means;

(f) torque measuring means operably associated with said cutter means for measuring the operating torque thereof;

(g) tachometer means operably associated with said cutter means for measuring the number of revolutions per unit time of said cutter means;

(h) means for generating a target constant;

(i) means for multiplying the measured torque with the number of revolutions per unit time and for comparing the product thereof with said target constant; and, (j) speed control means for regulating said rotary drive means in response to deviations of the product with said target constant so that a constant shredding rate is maintained.

9. The shredder of claim 8, wherein:

(a) said rotary drive means including an hydraulic motor.

10. The shredder of claim 9, wherein:

(a) said torque measuring means including drive pressure detection means for measuring the pressure of hydraulic fluid supplied to said hydraulic motor.

11. The shredder of claim 8, wherein:

(a) means being associated with said speed control means and with said drive means for adjusting the speed of said conveyor means in synchronism with the rotary speed of said cutter means.

12. The shredder of claim 8, wherein:

(a) said target constant being proportional to the shredding weight per unit time.

13. The shredder of claim 8, wherein:

(a) said speed control means adapted for regulating the rotary speed inversely proportional to the measured torque.

14. The method of controlling the shredding rate of a rotary shredder, comprising the steps of:

(a) measuring the torque generated by a rotary shredder means;

(b) meansuring the number of revolutions per unit time of the shredder means;

(c) setting a target constant proportional to the shredding weight per unit time;

(d) multiplying the torque by the number of revolutions of the shredder means and comparing the product thereof with said constant; and, (e) adjusting the speed of the shredder means inversely proportional to deviations of the product with said constant.

* * * * *